United States Patent [19]

Gasser

[11] Patent Number: 4,499,621

[45] Date of Patent: Feb. 19, 1985

[54] METHOD FOR WASHING LAUNDRY IN A PASS-THROUGH WASHING MACHINE

[75] Inventor: René Gasser, Wolfhausen, Switzerland

[73] Assignee: Maschinenfabrik AD. Schulthess & Co. AG, Zurich, Switzerland

[21] Appl. No.: 471,044

[22] Filed: Mar. 1, 1983

[30] Foreign Application Priority Data

Mar. 1, 1982 [CH] Switzerland ..... 1244/82

[51] Int. Cl.[3] ..... D06F 31/00

[52] U.S. Cl. ..... 8/158; 8/159; 68/27

[58] Field of Search ..... 8/158, 159; 68/27, 58, 68/18 R, 143, 145

[56] References Cited

U.S. PATENT DOCUMENTS 4,020,659 5/1977 Bhavsar ..... 68/27

FOREIGN PATENT DOCUMENTS 2900467 1/1979 Fed. Rep. of Germany .
2949228 8/1979 Fed. Rep. of Germany .
990566 4/1965 United Kingdom ..... 68/18 R
2066302 7/1981 United Kingdom ..... 68/27

*Primary Examiner*—Philip R. Coe
*Attorney, Agent, or Firm*—Bernard, Rothwell & Brown

[57] ABSTRACT

In a pass-through washing machine, use is made of three-minute rinse cycles. Accordingly, only two chambers are required for four rinsing stages during two wash cycles. The warm first rinse water of the pre-heated, pre-washed laundry is mixed to save time and energy required to heat the liquid mixture. The pass-through washing machine can thus be constructed in a compact form on a frame.

9 Claims, 3 Drawing Figures

Fig. 1
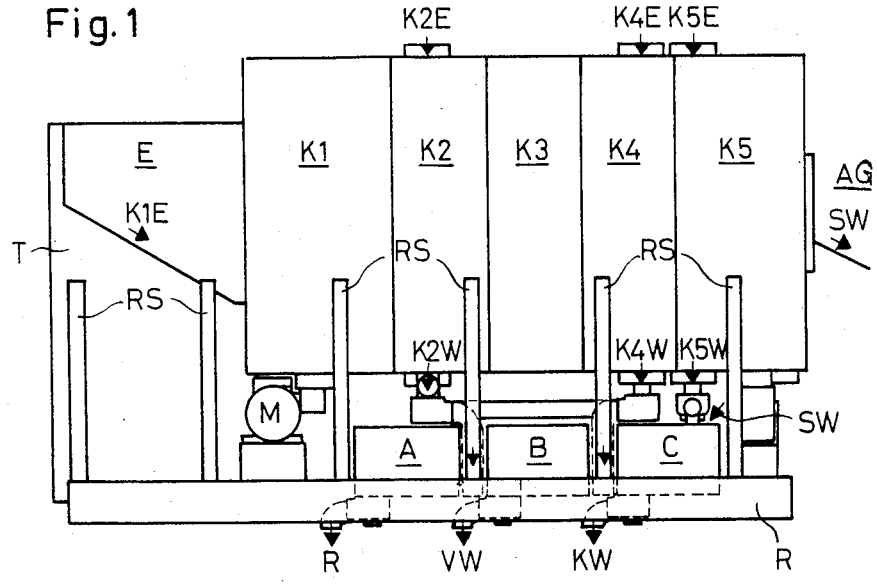
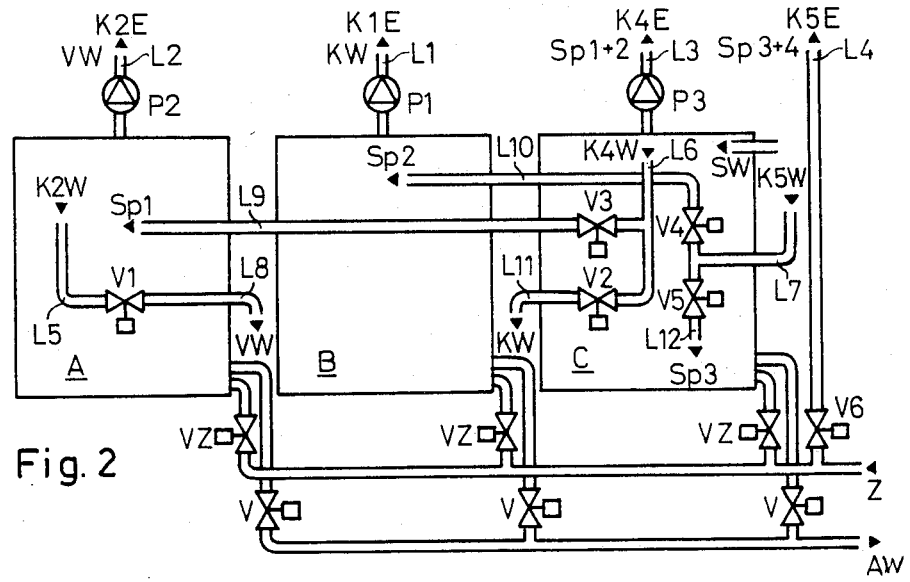
Fig. 2
Fig. 3
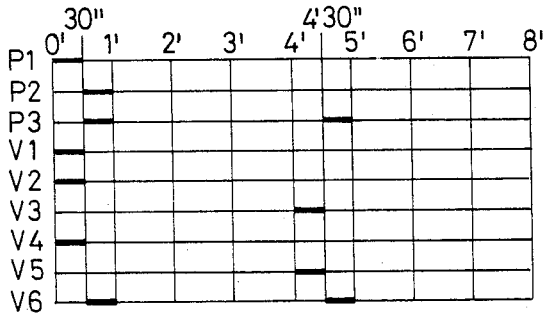

METHOD FOR WASHING LAUNDRY IN A PASS-THROUGH WASHING MACHINE

BACKGROUND OF THE INVENTION

1. Field of the Invention

The present invention relates to an improved method of washing laundry, as well as to improvements in pass-through washing machines.

2. Prior Art

Pass-through washing machines are known: one such is described in German Pat. No. A 29 49 228. This washing machine has a washing tube which is rotatable about its longitudinal axis. This washing tube is divided into washing chambers which are separated from each other during the washing process according to batches. The chambers are connected with pipes which can be blocked by valves in such a manner that a counter flow of liquid is achieved to transfer the laundry. The possibility of feeding this counter current not only into the immediately preceding chamber, but also to skip individual chambers, makes it possible to wash various types of laundry by specific stages. This type of washing machine requires ten chambers for the laundry, namely, two for the soaking zone, for example as many as five washing chambers associated with the washing zone and three chambers for carrying out three rinses.

Aside from the fact that in this embodiment a double drum machine is described, the expense can be recognized here, as well, which is necessary in order to separate the chambers from each other by batch and also to form passages in the unavoidable separating walls in order to transport the laundry by cycle from one chamber into the next.

A decrease in the number of chambers, however, is possible with the pass-through washing machine according to German Pat. No. A 29 00 467, namely, two chambers for the pre-wash or soaking zone, three chambers for the washing zone and two for the rinsing zone. A last chamber is intended as a finishing zone; accordingly, eight chambers are necessary at most, and if the finishing, which is not necessary for all laundry, is performed outside of the washing tube, seven chambers are sufficient for this washing machine. In each chamber the liquid mixture is specially adjusted to the respective requirements, in that the liquid is pumped away and led either into an intermediate container or directly into the subsequent chamber. In this manner the liquid mixture can be used more than once with the same wash, can flow or proceed with the wash and with different washes it can be held in storage. Since this can only be realized with a double drum machine, in which each chamber is provided in its own housing with its own drive for the chamber, the expense of material and working time to construct such a pass-through washing machine is great.

It is therefore an object of the invention to provide a solution for the above-described problem, with which the number of chambers can be significantly reduced, without having to alter the washing process, in order to be able to build a pass-through washing machine requiring significantly less material and thus also decreasing the working time necessary for construction.

SUMMARY OF THE INVENTION

The invention is set in the environment of a washing machine of the tubular type divided into chambers with separating walls. With such a machine, an improved method is achieved by controlling the handling period of the laundry in each of the chambers so that the time in each chamber is one-half that of the prior art, and after one-half of the cycle period draining the wash water or rinse water and feeding in new wash water and rinse water. The machine itself has five chambers, a first chamber for pre-washing, a second chamber for a second pre-wash and for full washing, a third chamber for full washing, and two chambers for four rinsing stages. A first conduit and valve means is provided to drain the pre-wash water and selectively lead the second pre-wash water or full wash water to the second chamber for full washing. Additional valve and conduit means are arranged in the last two chambers for the rinsing stages in order to drain the full wash water and at least the rinse water of three rinsing stages and to supply water for all four rinsing stages.

BRIEF DESCRIPTION OF THE DRAWINGS

FIG. 1 is a front view of a washing machine to perform the method;

FIG. 2 is a schematic illustration of the water supply lines with valves and pumps for the operation of the washing machine according to FIG. 1, and;

FIG. 3 is an operations time diagram for the valves and pumps in FIG. 2.

DETAILED DESCRIPTION OF THE PREFERRED EMBODIMENT

The pass-through washing machine according to FIG. 1 consists of five chambers K1–K5 joined to form a tube. Of these chambers, the two outside chambers K1 and K5 are provided with a feed funnel E and with a discharge chute AG. These two chambers K1 and K5 also have a greater axial length than the remaining chambers K2–K4. The chamber K1 is longer because the dry, air-filled, balled-up laundry requires more space than the wet, heavier laundry, and the chamber K5 requires more space because the water level must be kept lower than for the other washing stages because of the discharge chute AG, so that even in the chamber K5 a similar liquid mixture ratio is made possible in chamber K5 to that in the chambers K2 and K4.

In this arrangement chamber K1 is the pre-wash stage, chambers K2 and K3 are used for the full wash stage, while chambers K4 and K5 represent the rinsing stages. As usual, the two chambers K2 and K3 are equipped with heat insulating materials so that the heat lost to the environment can be held as low as possible.

This small number of chambers is accomplished from the knowledge that each rinsing stage represents in principle a thinning of the liquid. An optimal rinsing result is achieved with approximately three minutes of rinse time per rinse stage. Accordingly, sufficient time remains in an eight-minute washing cycle in order to include the time for two rinsing operations with the necessary emptying and filling of rinse waters. The time of eight minutes per wash cycle results from the period of 14 minutes necessary for a sterilization of the laundry when two chambers are available for heated washing and the liquid mixture can be heated within, at most, three minutes to the necessary temperature of 95° C.

In order to technically fulfill these conditions without increasing the required energy, but rather to further save it, this invention provides that the waste water from the four rinsing stages be reused. On the one hand, this allows the usual water requirement to fall from 30:1 of water per kg of dry laundry to about 10:1, and the use of the heat in the recycled water can be reduced to half of the otherwise required energy.

The means required for these special measures are described below with the aid of FIGS. 1 and 2. The chambers K2, K4 and K5 each have a gate with supply lines K2E, K4E and K5E and discharge lines K2W, K4W and K5W for the supply and discharge of the necessary liquids and the supply of heat. The supply line K1E to the filling funnel E effects the wetting of the dry laundry and simultaneously effects the soaking. The last rinse water from the chamber K5 travels with the laundry as surge of water into a draining device (not shown), which can be a centrifuge or a press.

Three containers A, B, C are located beneath the chambers to catch the first, second and third rinse water drained from the chambers K4 and K5 and to catch the surge water SW. The control of the coordination of the rinse waters to the containers A, B, C or the discharge of the pre-wash water VW and the full wash water KW is controlled by valves V1–V5, and the supply of the liquids to the chambers K2, K4 and K5 inclusive to the filling funnel is accomplished by means of the pumps P1–P3 and a valve V6, which is connected to the fresh water line Z. The fresh water line Z is connected with all three containers A, B, C by means of valves Vz and a waste water line AW correspondingly leads from the containers A, B, C with valves V and also receives the waste water from the chambers K2 and K4 through the valves V1 and V2 and the lines L8 and L11.

To explain the types of operation, special reference is made to the FIGS. 2 and 3. At time 0′, which is identical with the time 8′ of the preceding cycle, the first rinse water Sp1 from the preceding washing cycle is located in the container A, and the remaining containers B and C are empty except for residual water. With the end of the cycle, the laundry was conveyed from each chamber to the next stage. Therefore, the pre-washed laundry lies with the pre-wash liquid VW in the chamber K2 and the fully washed laundry lies in the full wash liquid KW in the chamber K4. The valves V1 and V2 are opened, so that the pre-wash liquid VW can pass out of the gate exit K2W through the lines L5 and L8 and the full wash liquid KW can pass into the drain through the lines L6 and L11.

At the same time, the valve V4 is also opened, in order to conduct the second rinse water Sp2 out of the gate exit KSW into the container B through the lines L7 and L10. This rinse water Sp2 is fed through the line L1 to the rinse inlet K1E in the filling funnel E by means of the pump P1. By virtue of the fact that wet laundry passes together with the fourth rinse water Sp4 out of the chamber K5 into the water removal device and the surge water SW passes from there into the container C, the container A is now filled with the first rinse water Sp1 of the preceding cycle and the container C is now filled with the surge water SW.

At time 30″ the valves V1, V2, V4 are thus closed and the pump P1 is turned off. The pumps P2 and P3 are also turned on and the valve V6 is opened. In this manner the first rinse water Sp1 of the preceding cycle is removed from the container A and led to the chamber K2 through the line L2 and the inlet line K2E. The pump P3 feeds the water from the container C into the chamber K4 through the line L3 as the first rinse water Sp1 and fresh water is supplied from the line Z through the line L4 to the chamber K5 as a third rinse water Sp3 by means of the valve V6.

In accordance with the above-mentioned awareness that three minutes are sufficient for each rinse stage, at time 4′ the valves V3 and V5 are opened to lead the first rinse water Sp1 into the container A and to lead the third rinse water Sp3 into the container C. Accordingly, water is then located in the containers A and C, and additional residual water, which can be surge water SW overflowing from container C can be located in container B.

Thirty seconds later, at time 4′30″, the pump P3 is turned on in order to pump the water out of the container C through the line L3 to the chamber K4 as a second rinse water Sp2. At the same time, fresh water is fed through the valve V6 and the line L4 out of the line Z into the chamber K4 as a fourth rinse water Sp4.

The wash cycle is ended at time 8′. During this entire time the tube has been oscillated back and forth, in order to wash the laundry in a known manner. To assure that the water levels in the individual chambers K1, K2, K4 and K5 are adapted to the respective needs, the pump P1 is time-controlled and the pumps P2, P3 and the valve V6 are controlled by level switches according to the water level in the associated chambers K2, K4 and K5.

If care is taken that the second rinse water Sp2 coming from the chamber K4 is about 40° C., the laundry is warmed to this 40° C. in the pre-wash cycle. This temperature may not be exceeded, as is well known, because of protein fixation. In the full wash 60° C. first rinse water Sp1 is used, so that a mixing temperature of about 50° C. results, which is then to be heated to the full wash temperature. By means of this particular use of the first and second rinse waters Sp1 and Sp2, the above-mentioned short full wash period of 16 minutes can be achieved and in addition to a water savings of around 66%, heat energy of about 50% can be saved while also providing a pass-through period for the laundry of 40 minutes.

With this arrangement of chambers K1–K5, containers A, B, C and valves, pumps and lines, a compact pass-through washing machine can be produced. According to FIG. 1 the tube with the chambers K1–K5 is arranged above the containers A, B, C and is rollingly supported in a known manner on a frame R. The drive motor M together with transmission and friction rollers or gear connection to the tube are also located on this frame R. The illustrated frame supports Rs serve to connect cover plates, of which one cover plate P can be seen behind the tube. The front plates are removed accordingly.

It is thus sufficient for this washing machine to provide in the washroom a drainage channel for the liquids to be drained from the waste water line AW, namely, the pre-wash water VW, full wash water KW and cleaning water RW, and a connection for the fresh water supply Z and a device to heat the liquid mixture in the chamber K2. An exemplary embodiment having an hourly laundry through-put of 150–300 kg has a length of about 3.5 meters and a total height of slightly over 2.5 meters.

I claim:

1. A method for washing laundry in a pass-through washing machine of the type having a tube divided into a plurality of chambers by separating walls provided with transfer openings, wherein at least one of the chambers contains wash liquid and at least another one of the chambers contains rinse liquid, the laundry in each of the chambers being treated with liquid during a single cycle, and wherein after completion of said single cycle, the laundry in each chamber is transferred through a transfer opening into a succeeding chamber for treatment with liquid during a succeeding cycle or onto a discharge chute succeeding a final chamber of said plurality of chambers, with the improvements comprising; controlling the treatment time of the laundry in at least one of the chambers, so that the time of a first treatment in that chamber is one-half the cycle time, and after said one-half of the cycle time draining the liquid in that chamber and feeding a second liquid into that chamber for a second treatment of the laundry in that chamber for the remaining time of the cycle, and prior to transferring said laundry into a succeeding chamber or onto said discharge chute.

2. A method according to claim 1 wherein said plurality of chambers includes a pre-wash chamber for the introduction of pre-wash liquid, succeeded by a clear wash chamber for the introduction of clear wash liquid, and wherein pre-wash liquid is drained after a pre-wash cycle, clear wash liquid is drained after a clear wash cycle, and said rinse liquid is drained after one-half of the time of a rinse cycle or after completion of a rinse cycle and thereafter used in another cycle.

3. A method according to claim 2 wherein said plurality of chambers includes a plurality of rinse chambers for the introduction of rinse liquid, and wherein rinse liquid in each of said rinse chambers is drained after one-half of the time of a rinse cycle or after completion of a rinse cycle, and thereafter used in another cycle.

4. A method according to claim 3 wherein a first rinse liquid is drained from a first rinse chamber after one-half the cycle time of a first rinse cycle, and said drained first rinse liquid is thereafter used as a clear wash liquid; a second rinse liquid is drained after completion of the cycle time of said first rinse cycle, and said drained second rinse liquid is thereafter used as a pre-wash liquid; a third rinse liquid is drained from a second rinse chamber after one-half the cycle time of a second rinse cycle, and said drained third rinse liquid is thereafter used as a second rinse liquid; and a fourth rinse liquid is removed from said laundry after completion of the cycle time of said second rinse cycle, and said fourth rinse liquid is thereafter used as a first rinse liquid.

5. A method according to claim 1, in which, after a clear wash cycle, residual heat in the laundry and in liquid remaining therein is used to heat the rinse liquid.

6. A method for washing laundry in a pass-through washing machine of the type having a tube divided in a plurality of chambers by separating walls provided with transfer openings, wherein the laundry in each of the chambers is treated with liquid during a cycle, and after completion of said cycle the laundry in each chamber is transferred through a transfer opening into a succeeding chamber or onto a discharge chute succeeding a final chamber, the method comprising:

(a) introducing a batch of laundry and a pre-wash liquid into a pre-wash chamber of said plurality of chambers;

(b) treating said batch of laundry in said pre-wash chamber with said pre-wash liquid during a pre-wash cycle;

(c) transferring said batch of laundry and said pre-wash liquid to a first clear wash chamber of said plurality after completion of said pre-wash cycle;

(d) draining said pre-wash liquid from said first clear wash chamber;

(e) treating said batch of laundry in said first clear wash chamber with a clear wash liquid during a first clear wash cycle;

(f) transferring said batch of laundry and said clear wash liquid to a second clear wash chamber of said plurality after completion of said first clear wash cycle, and continuing to treat said batch of laundry in said second clear wash chamber with said clear wash liquid during a second clear wash cycle;

(g) transferring said batch of laundry and said clear wash liquid to a first rinse chamber of said plurality after completion of said second clear wash cycle;

(h) draining said clear wash liquid from said first rinse chamber;

(i) treating said batch of laundry in said first rinse chamber with a first rinse liquid during a first half of a first rinse cycle;

(j) draining said first rinse liquid from said first rinse chamber after completion of said first half of said first rinse cycle;

(k) treating said batch of laundry in said first rinse chamber with a second rinse liquid during a second half of said first rinse cycle;

(l) transferring said batch of laundry and said second rinse liquid to a second rinse chamber of said plurality after completion of said first rinse cycle;

(m) draining said second rinse liquid from said second rinse chamber;

(n) treating said batch of laundry in said second rinse chamber with a third rinse liquid during a first half of a second rinse cycle;

(o) draining said third rinse liquid from said second rinse chamber after completion of said first half of said second rinse cycle;

(p) treating said batch of laundry in said second rinse chamber with a fourth rinse liquid during a second half of said second rinse cycle;

(q) transferring said batch of laundry and said fourth rinse liquid to said discharger chute; and (r) separating said fourth rinse liquid from said batch of laundry, wherein each of said cycles is of the same time duration, and wherein said first rinse liquid is used after said draining thereof as clear wash liquid, said second rinse liquid is used after said draining thereof as pre-wash liquid, said third rinse liquid is used after said draining thereof as second rinse liquid, and said fourth rinse liquid is used after the separation thereof as first rinse liquid.

7. The method of claim 6 wherein after the draining of said clear wash liquid, residual heat in the batch of laundry and in liquid remaining therein is used to heat rinse liquid.

8. The method of claim 6 wherein additionally, after transferring said batch of laundry to said clear wash chamber, succeeding separate batches of laundry are introduced into said pre-wash chamber to be washed in said machine according to steps (a) through (r) of said method.

9. The method of claim 8 wherein after the draining of said clear wash liquid, residual heat in the batch of laundry and in liquid remaining therein is used to heat rinse liquid.

* * * * *

UNITED STATES PATENT AND TRADEMARK OFFICE

CERTIFICATE OF CORRECTION

PATENT NO. : 4,499,621

DATED : February 19, 1985

INVENTOR(S) : RENE GASSER

It is certified that error appears in the above-identified patent and that said Letters Patent is hereby corrected as shown below:

Column 3, line 48, delete "KSW" and substitute therefor --K5W--.

Column 5, claim 5, line 46, delete "1" and substitute therefor --4--.

Signed and Sealed this

*Fifteenth* Day of *October 1985*

[SEAL]

*Attest:*

*Attesting Officer*

DONALD J. QUIGG

*Commissioner of Patents and Trademarks—Designate*